US011041415B2

(12) United States Patent
Altherr et al.

(10) Patent No.: US 11,041,415 B2
(45) Date of Patent: Jun. 22, 2021

(54) VALVE CONTROL

(71) Applicant: Mahle International GmbH, Stuttgart (DE)

(72) Inventors: Patrick Altherr, Stuttgart (DE); Thorsten Ihne, Stuttgart (DE); Mario Mohler, Stuttgart (DE); Markus Walch, Bretten (DE)

(73) Assignee: Mahle International GmbH

( * ) Notice: Subject to any disclaimer, the term of this patent is extended or adjusted under 35 U.S.C. 154(b) by 0 days.

(21) Appl. No.: 16/813,151

(22) Filed: Mar. 9, 2020

(65) Prior Publication Data

US 2020/0291828 A1 Sep. 17, 2020

(30) Foreign Application Priority Data

Mar. 11, 2019 (DE) ..... 10 2019 203 233.8

(51) Int. Cl.
*F01L 13/00* (2006.01)
*F01L 1/18* (2006.01)
(Continued)

(52) U.S. Cl.
CPC ..... *F01L 13/0036* (2013.01); *F01L 1/181* (2013.01); *F01L 13/0021* (2013.01); *F01L 1/053* (2013.01);
(Continued)

(58) Field of Classification Search
CPC ... F01L 1/053; F01L 2001/0535; F01L 1/181; F01L 1/267; F01L 13/0036; F01L 2305/02
(Continued)

(56) References Cited

U.S. PATENT DOCUMENTS 8,191,524 B2 6/2012 Elendt et al.
8,714,125 B2 * 5/2014 Kamichika ..... F01L 1/18 123/90.39
(Continued)

FOREIGN PATENT DOCUMENTS

DE 202009016619 U1 9/2010
DE 102015011907 A1 4/2016
(Continued)

OTHER PUBLICATIONS

English abstract for DE-102017213539.
(Continued)

*Primary Examiner* — Jorge L Leon, Jr.
(74) *Attorney, Agent, or Firm* — Fishman Stewart PLLC

(57) ABSTRACT

A valve control for an internal combustion engine may include a tilt lever, a cam shaft, two cam groups arranged on the cam shaft, a roller bolt arranged on the tilt lever, and an adjusting assembly including a switching pin that engages through the roller bolt. The roller bolt may include two rotatable rollers. The switching pin may be adjustable into a switching position and into a home position. The switching pin may cooperate with a slotted guide of the cam shaft when in the switching position and may have no contact with the slotted guide when in the home position. When the switching pin is in the switching position, the two rollers may be axially adjustable via the adjusting assembly. The switching pin may be axially movable in the roller bolt and the two rollers may be axially movable on the roller bolt into one of two roller positions.

20 Claims, 5 Drawing Sheets

(51) Int. Cl.
*F01L 1/053* (2006.01)
*F01L 1/26* (2006.01)

(52) U.S. Cl.
CPC ..... *F01L 1/267* (2013.01); *F01L 2013/0052* (2013.01); *F01L 2305/02* (2020.05)

(58) Field of Classification Search
USPC ..... 123/90.16, 90.17, 90.21, 90.27, 90.39, 123/90.44
See application file for complete search history.

(56) References Cited

U.S. PATENT DOCUMENTS

| | | | | |
|---|---|---|---|---|
| 9,777,603 | B2 | 10/2017 | Kaan et al. | |
| 2009/0095241 | A1* | 4/2009 | Ihlemann | F01L 13/0036 123/90.16 |
| 2017/0241305 | A1* | 8/2017 | Xi | F01L 1/08 |

FOREIGN PATENT DOCUMENTS

| | | | |
|---|---|---|---|
| DE | 102017103104 | A1 | 8/2017 |
| DE | 102016209600 | A1 | 12/2017 |
| DE | 102016220612 | A1 | 4/2018 |
| DE | 102017213539 | A1 | 2/2019 |
| JP | 2002-188418 | A | 7/2002 |

OTHER PUBLICATIONS

English abstract for DE-102015011907.
English abstract for JP-2002-188418.
English abstract for DE-102016209600.
English abstract for DE-102016220612.

* cited by examiner

VALVE CONTROL

CROSS-REFERENCE TO RELATED APPLICATIONS

This application claims priority to German Patent Application No. DE 10 2019 203 233.8, filed on Mar. 11, 2019, the contents of which are hereby incorporated by reference in their entirety.

TECHNICAL FIELD

The invention relates to a valve control of an internal combustion engine.

BACKGROUND

A valve control is used to variably control valves of an internal combustion engine. The valve control can thereby be embodied, for example, as a slide roller system. Rollers are thereby mounted on a movable roller bolt, which can be axially adjusted in two positions. In the respective positions, the rollers cooperate alternately with cam profiles, which differ from one another, which impacts the lifting movement of the rollers and, via the latter, the lifting movement of the tilt lever. By adjusting the rollers, the valves can thus be variably controlled. To adjust the roller bolt comprising the rollers, switching pins are used from time to time, which can be operated by means of an actuator and which cooperate with a slotted guide. A guide groove, which axially guides the switching pin and the roller bolt connected thereto into the respective position, is formed for this purpose on the slotted guide. An X-shaped slotted guide thereby offers significant advantages as compared to Y-shaped guide grooves, which are separated from one another. In particular the number of components and installation space can thus be reduced. The installation space advantage of the X-shaped guide groove is limited, however, in that the roller bolt comprising the rollers is laterally moved and protrudes on the tilt lever. As a result, the installation space to the following component—for example to the adjacent tilt lever or to the bearing bracket—has to be kept free. As a result, the ability to realize the valve control suffers, for example in the case of small cylinder spacings as well as in the case of SOHC engines (SOHC: Single Overhead Camshaft).

SUMMARY

It is thus the object of the invention to specify an improved or at least an alternative embodiment for a valve control of the generic type, in the case of which the described disadvantages are overcome.

This object is solved according to the invention by means of the subject matter of the independent claim(s). Advantageous embodiments are subject matter of the dependent claim(s).

The present invention is based on the general idea of separating the adjusting and the mounting of the rollers from one another. A valve control is provided for an internal combustion engine and has a tilt lever axis and a tilt lever, which is rotatably mounted on the tilt lever axis. The valve control further has a cam shaft, which is mounted axially parallel to the tilt lever axis and on which two cam groups, which each comprise two axially adjacent cams, are arranged axially spaced apart from one another. The two cam groups are secured to the cam shaft in a rotationally fixed and translationally fixed manner. Further, the cam shaft is secured in a translationally fixed manner—i.e. is axially fixed—in the valve control. The valve control also has a roller bolt, which is arranged on the tilt lever axially parallel to the tilt lever axis, comprising two rotatable rollers, which are axially spaced apart from one another. The valve control furthermore has an adjusting assembly comprising a switching pin, which engages through the roller bolt and which can be adjusted into a switching position and into a home position radially to the roller bolt. In the switching position, the switching pin cooperates with a slotted guide on the cam shaft, and has no contact with the slotted guide in the home position. In the switching position of the switching pin, the adjusting assembly axially adjusts the rollers between two roller positions, wherein in the respective roller position, the rollers are alternately drive-connected to a respective one of the cams of the respective cam group. According to the invention, the switching pin is arranged between the two rollers and in an axially movable manner in the roller bolt. The slotted guide is secured to the cam shaft in a rotationally fixed manner between the two cam groups. The roller bolt is axially fixed. The rollers are arranged in an axially moveable manner on the roller bolt and are axially coupled with the switching pin of the adjusting assembly. The mounting and the adjusting of the rollers on the roller bolt in the valve control are separated from one another in this advantageous way. The roller bolt serves to mount the rollers and remains non-movable. The adjustment of the rollers is taken over via the adjusting assembly, which suitably effects the adjustment of the rollers on the axially secured roller bolt. The switching pin is thereby arranged in an axially movable manner between the rollers, so that the roller bolt is not entrained when guiding the switching pin in a guide groove of the slotted guide and when adjusting the rollers via the adjusting assembly. The switching pin can cooperate with the slotted guide, for example via an elongated hole in the roller bolt. The slotted guide is thereby arranged between the two cam groups, so that an axial length of the cam shaft can also be reduced.

An X-shaped guide groove can advantageously be formed on the slotted guide. To further reduce the necessary installation space, the slotted guide can laterally abut against the adjacent cams of the two cam groups. As a whole, the installation space for the valve control can be reduced significantly and the valve control according to the invention can also be realized in the case of a small installation space, such as, for example, in the case of small cylinder spacings as well as in the case of SOHC engines.

It can advantageously be provided that the rollers are secured spaced apart from one another to a roller sleeve, which can be axially moved on the roller bolt, and that the switching pin is axially secured to the roller sleeve. In the switching position, the switching pin then axially moves the roller sleeve into a first sleeve position and into a second sleeve position, wherein the respective sleeve position of the roller sleeve corresponds to the respective roller position of the two rollers. The roller sleeve can thus be axially moved between two sleeve positions, which define the end position of the rollers and thus the respective roller positions. The roller sleeve can then advantageously be held in the respective sleeve position by means of a sleeve latching unit. The sleeve latching unit thereby has at least one spring and at least one latching element, which are secured inside the roller bolt and which cooperate with the roller sleeve radially to the roller bolt.

In the home position and in the switching position, the switching pin can be held by means of a pin latching unit. The pin latching unit then has at least one spring and at least one latching element, which are secured to the roller sleeve so as to be axially movable with the latter and which, transversely to the longitudinal central axis of the switching pin, cooperate with the latter. In the home position and in the switching position, the switching pin can alternatively be held by means of a pressure latching unit. The pressure latching unit then has at least one pressure piece, which is secured to the roller sleeve so as to be axially movable with the latter and which, transversely to the longitudinal central axis of the switching pin, cooperated with the latter.

In the case of an advantageous further development of the valve control, it can be provided that the switching pin is axially secured in a moving bolt. The moving bolt is then mounted on the tilt lever axially parallel to the tilt lever axis and in an axially movable manner. In the switching position, the switching pin axially moves the moving bolt into a first bolt position and into a second bolt position, wherein the respective bolt position of the moving bolt corresponds to the respective roller position of the two rollers. The roller bolt can then be arranged between the cam shaft and the moving bolt, and the switching pin can cooperate with the slotted guide via an elongated hole in the roller bolt. It can advantageously be provided that in the home position and in the switching position, the switching pin is held by means of a pin latching unit. The pin latching unit then has at least one spring and at least one latching element, which are secured inside the moving bolt and which, transversely to the longitudinal central axis of the switching pin, cooperate with the latter.

The moving bolt is thereby mounted in such a way that that it does not protrude on the tilt lever in the respective bolt position. The moving bolt can thus be mounted in an axially movable manner in a fork-like lever holder and can remain arranged axially inside the lever holder in the respective bolt position. The moving bolt can thus be embodied to be short, so that its axial length does not exceed the axial length of the tilt lever or of the lever holder. The moving bolt can in particular be so short that it is displaced in the respective bolt position inside the lever holder and does not laterally protrude from the latter. On its first longitudinal end, the moving bolt can be mounted in a rotationally fixed and in a form-fitting manner in the lever holder by means of a securing element, and, on its second longitudinal end, can be held in the respective bolt position by means of a bolt latching unit. The securing element is preferably a feather key or a cylinder pin. Further forms of the securing element, however, are generally also possible.

It can advantageously be provided that the rollers are secured spaced apart from one another to a roller sleeve, which can be axially moved on the roller bolt, and that the switching pin is axially secured to the roller sleeve, so that the rollers comprising the roller sleeve can be moved into the respective roller position when adjusting the moving bolt into the respective bolt position.

It can alternatively be provided that the rollers are mounted in an axially movable manner on the roller bolt and that they are encompassed in some areas by an entraining unit, which is secured to the moving bolt. When adjusting the moving bolt into the respective bolt position, the rollers can then be entrained by the entraining unit and can be adjusted into the respective roller position. The respective roller can advantageously be encompassed in some areas via two stop surfaces of the entraining unit, which extend radially to and spaced apart from one another. An axial distance of the respective two stop surfaces thereby defines an axial functional play of the respective roller. The entraining unit can advantageously be embodied in one piece or integrally, respectively. In the alternative, the rollers can each only be capable of being adjusted on one side by means of one stop surface each, as a result of which the necessary installation space can be further reduced. The two stop surfaces are then suitably arranged between the two rollers so as to abut against the latter. The entraining unit can be embodied, for example, as a sheet metal part, which is preferably formed or which is brought into its final geometry, respectively, by means of punching and by means of shaping.

In summary, the installation space requirement for the valve control according to the invention can be reduced significantly, so that said valve control can also be realized in the case of a small installation space with small cylinders spacings as well as in the case of SOHC engines. The valve control is thereby embodied in a robust and simple way and the number of the components is reduced. The costs can thus be reduced and the assembly can be simplified. The mass to be moved is advantageously also reduced. The lubrication in the valve control can further be simplified, because the roller bolt is mounted so as not to be movable.

Further important features and advantages of the invention follow from the subclaims, from the drawings, and from the corresponding figure description on the basis of the drawings.

It goes without saying that the above-mentioned features and the features, which will be described below, cannot only be used in the respective specified combination, but also in other combinations or alone, without leaving the scope of the present invention.

Preferred exemplary embodiments of the invention are illustrated in the drawings and will be described in more detail in the description below, whereby identical reference numerals refer to identical or similar or functionally identical components.

BRIEF DESCRIPTION OF THE DRAWINGS

In each case schematically.

DETAILED DESCRIPTION

Figure 1:
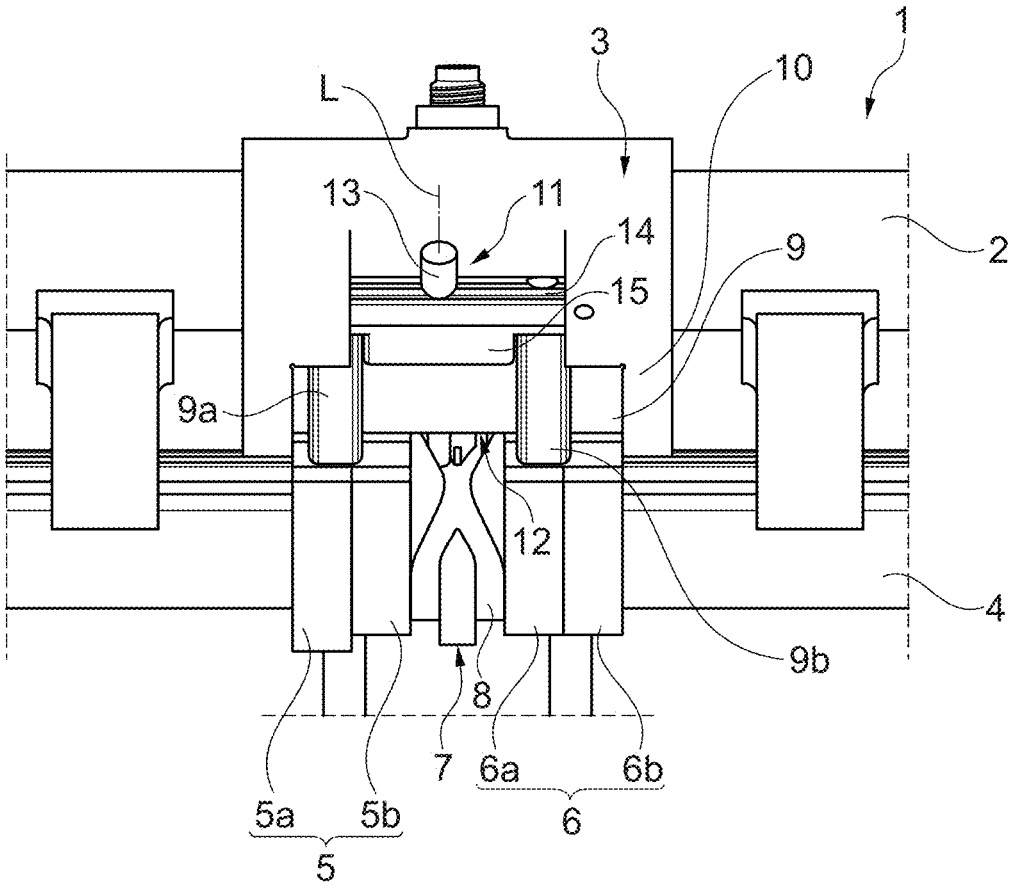
FIG. 1 shows a view of a valve control according to the invention in a first embodiment.
Figure 2:
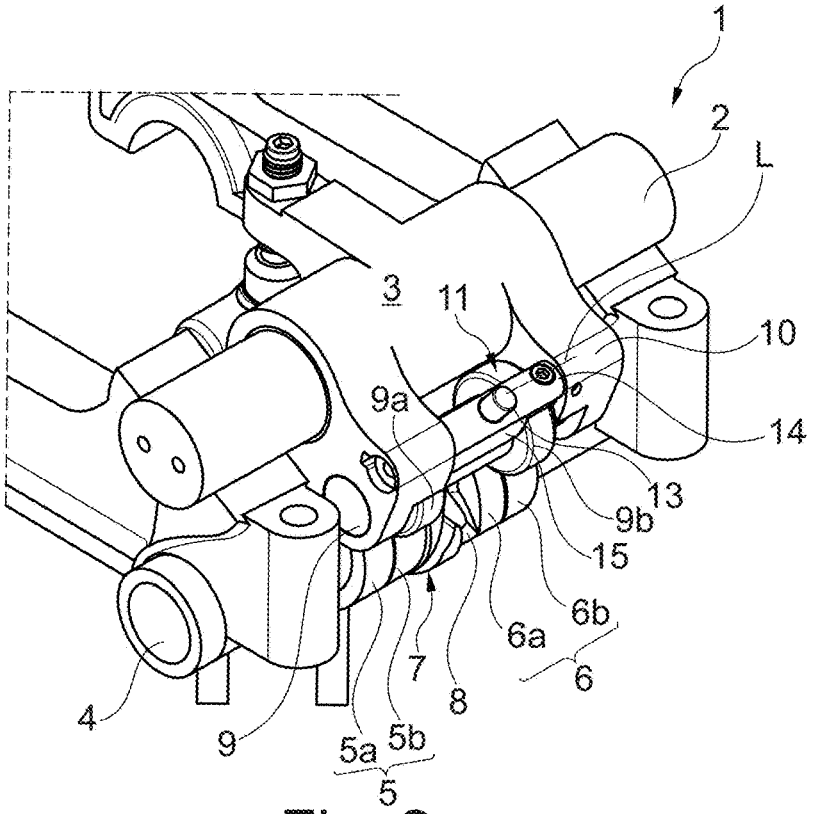
FIGS. 2 and 3 show further views of the valve control according to the invention in the first embodiment.
Figure 3:
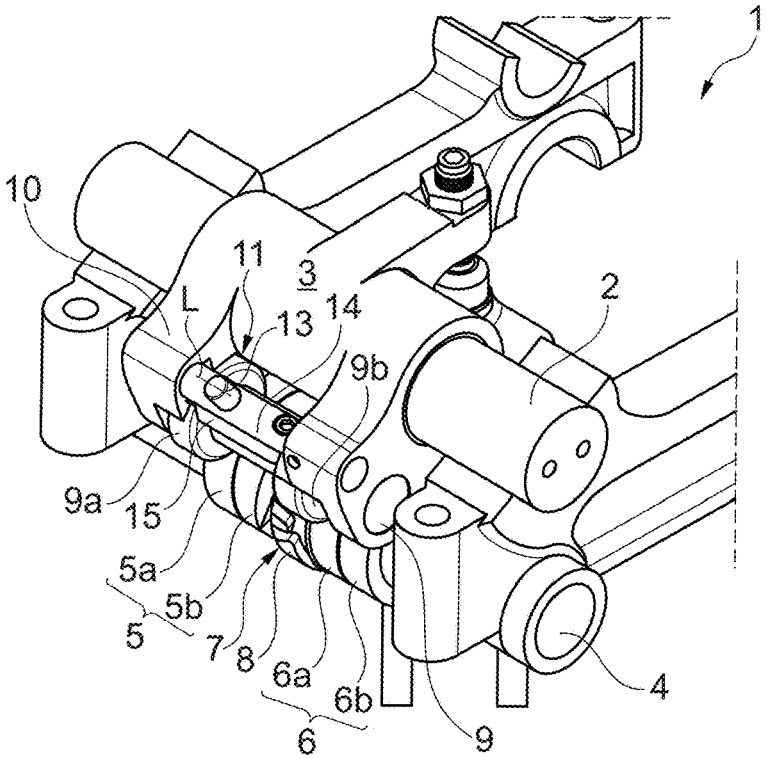
Figure 4:
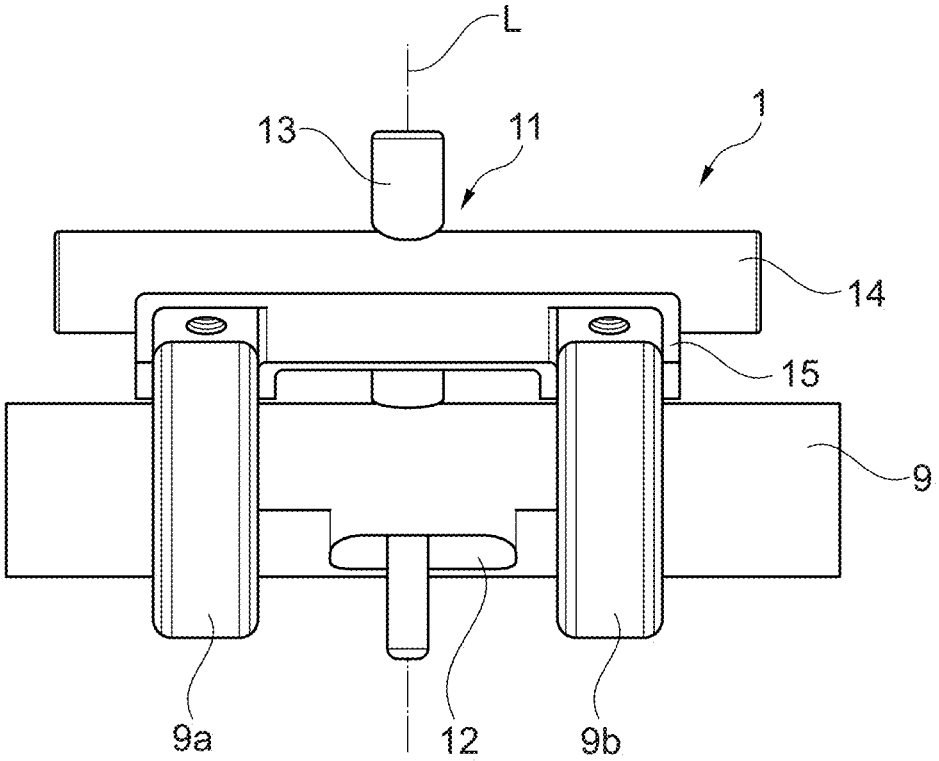
FIGS. 4 and 5 show detail views of the valve control according to the invention in the first embodiment.
Figure 5:
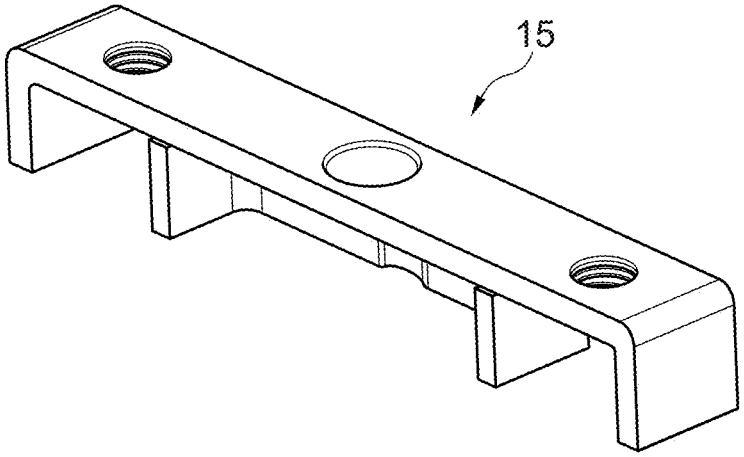

FIG. 1 shows a view of a valve control 1 according to the invention in a first embodiment. FIG. 2 and FIG. 3 show further views of the valve control 1 according to the invention from FIG. 1. Detail views of the valve control 1 according to the invention from FIG. 1 to FIG. 3 are shown in FIG. 4 and FIG. 5.

With reference to FIG. 1 to FIG. 5, the valve control 1 according to the invention has a tilt lever axis 2 and a tilt lever 3, which is rotatably mounted on the tilt lever axis 2. The valve control 1 further has a cam shaft 4, which is mounted axially parallel to the tilt lever axis 2. A first cam group 5 comprising two axially adjacent cams 5*a* and 5*b* and a second cam group 6 comprising two axially adjacent cams 6*a* and 6*b* is arranged on the cam shaft 4. The cam groups 5 and 6 are axially spaced apart from one another. A slotted guide 7, on which an X-shaped guide groove 8 is formed, is arranged between the cam groups 5 and 6. The slotted guide 7 laterally abuts against the respective cams 5*b* and 6*a* and can also be embodied in one piece therewith.

The valve control 1 further has a roller bolt 9 comprising two rotatable rollers 9*a* and 9*b*, which are axially spaced apart from one another. The roller bolt 9 is thereby secured in a fork-like lever holder 10 of the tilt lever 3 so as to be axially parallel to the tilt lever axis 2. In the case of the first embodiment of the valve control 1, the rollers 9*a* and 9*b* are mounted in an axially movable manner on the roller bolt 9 and can be axially adjusted between two roller positions. In the respective roller position, the rollers 9*a* and 9*b* are alternately drive-connected to a respective one of the cams 5*a* or 5*b* and 6*a* or 6*b* of the respective cam group 5 and 6. In FIG. 1 and FIG. 2, the respective rollers 9*a* and 9*b* cooperate with the respective cams 5*a* and 6*a*, and with the respective cams 5*b* and 6*b* in FIG. 3. In FIG. 1 and FIG. 2, the rollers 9*a* and 9*b* are thus in the other roller position than in FIG. 3. The cams 5*a* and 6*a* thereby have different groove profiles to the cams 5*b* and 6*b*, so that the rollers 9*a* and 9*b* perform a different lifting movement, depending on the roller position, and suitably transfer said lifting movement to the tilt lever 3.

The valve control 1 furthermore has an adjusting assembly 11 comprising a switching pin 13, which engages through an elongated hole 12 of the roller bolt 9 and which can be adjusted into a switching position and into a home position radially to the roller bolt 9. In the switching position, the switching pin 13 cooperates with the slotted guide 7 and has no contact therewith in the home position. In the case of the first embodiment of the valve control 1, the switching pin 13 is axially secured in a moving bolt 14 and is mounted in the latter in a radially adjustable manner. The moving bolt 14 is thereby mounted axially parallel to the tilt lever axis 2 and in an axially movable manner in the lever holder 10 of the tilt lever 3. In the switching position, the switching pin 13 cooperates with the guide groove 8 and is moved axially to the tilt lever axis 2 by means of the moving bolt 14. The moving bolt 14 is thus axially adjusted into one of the two bolt positions. In response to the adjustment into the respective bolt position, the moving bolt 14 entrains the two rollers 9*a* and 9*b* and moves them out of the one roller position into the other roller position. For this purpose, an entraining unit 15, which laterally encompasses the rollers 9*a* and 9*b*, is secured to the moving bolt 14.

Figure 6:
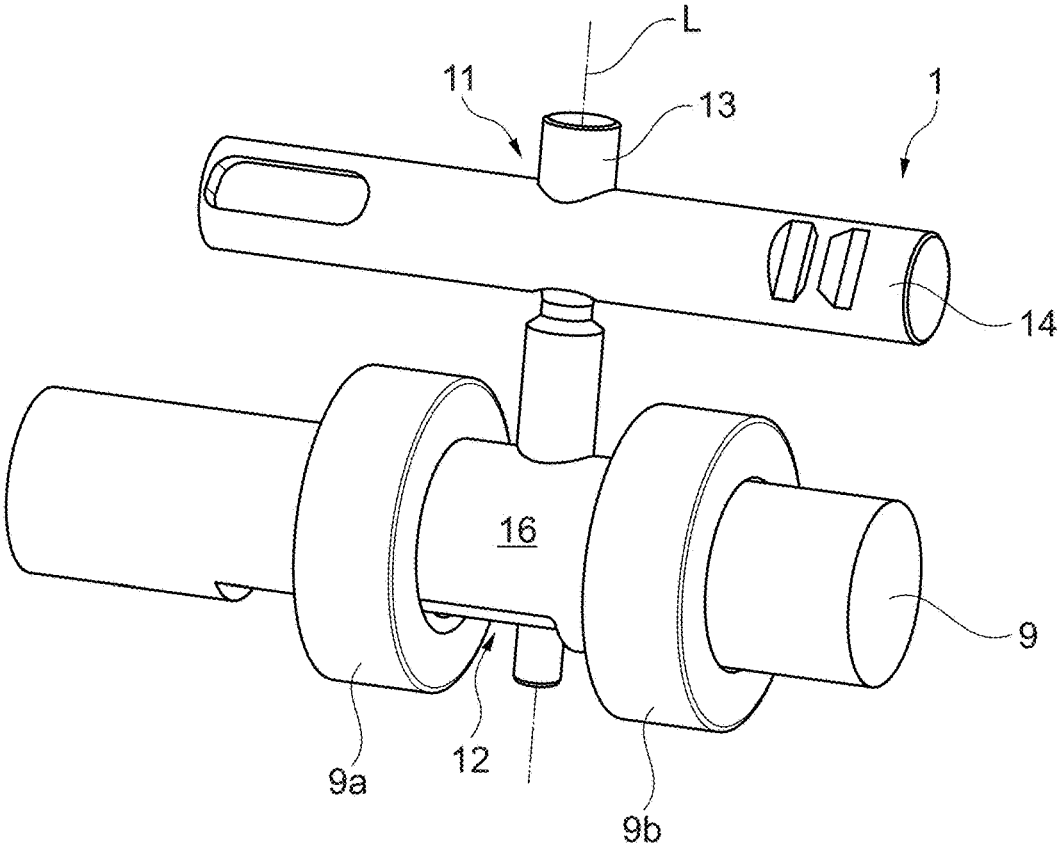
FIG. 6 shows a detail view of the valve control according to the invention in a second embodiment.

FIG. 6 shows a detail view of the valve control 1 according to the invention in a second embodiment. The two rollers 9*a* and 9*b* are axially secured to a roller sleeve 16 here, and the roller sleeve 16 is mounted in an axially movable manner on the roller bolt 9. The switching pin 13 is thereby axially secured to the roller sleeve 16 and, in the switching position, then axially moves the roller sleeve 16 into a first sleeve position and into a second sleeve position. The respective sleeve position of the roller sleeve 16 thereby corresponds to the respective roller position of the two rollers 9*a* and 9*b*. In the second embodiment of the valve control 1, the entraining unit 15 can thus be forgone, so that the entrained weight is reduced in the valve control 1. The valve control 1 in the second embodiment moreover corresponds to the valve control 1 in the first embodiment shown in FIG. 1 to FIG. 5.

In the first and in the second embodiment, the moving bolt 14 is thereby mounted in such a way and is so short that it does not protrude from the lever holder 10 of the tilt lever 3 in its bolt position. The installation space requirement for the valve control 1 according to the invention is thus significantly reduced.

Figure 7:
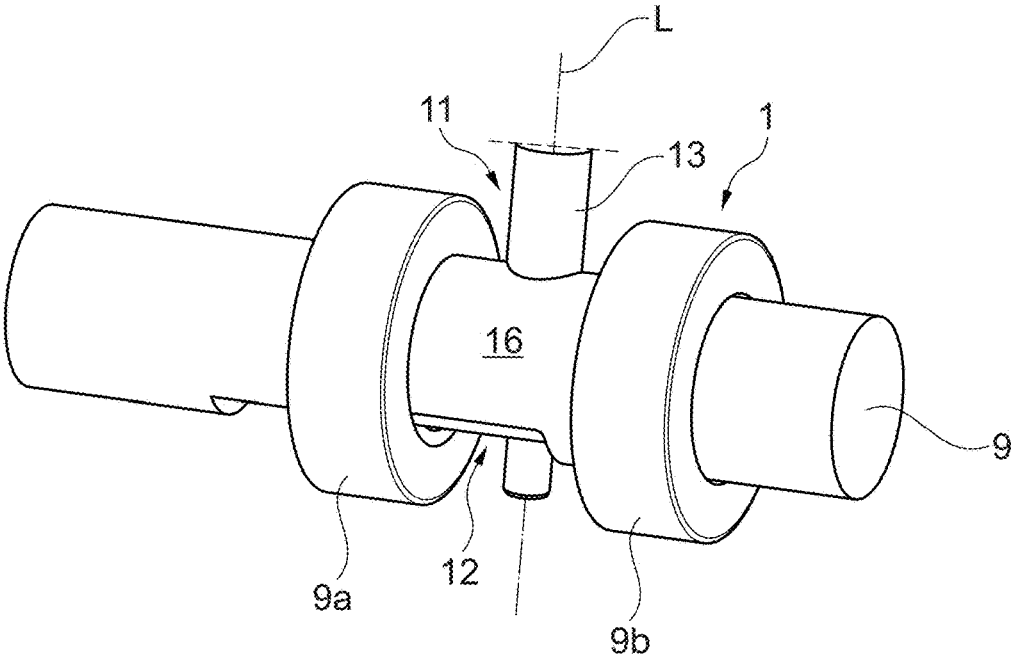
FIG. 7 shows a detail view of the valve control according to the invention in a third embodiment.

FIG. 7 shows a detail view of the valve control 1 according to the invention in a third embodiment. Here, the switching pin 13 is mounted in the roller bolt 9 so as to be axially movable in the elongated hole 12 and so as to be radially adjustable into the switching position and into the home position. In the third embodiment of the valve control 1, the moving bolt 14 can be forgone, so that the valve control is further simplified. As in the second embodiment of the valve control 1, the two rollers 9*a* and 9*b* are axially secured to the roller sleeve 16 here, so that the roller sleeve 16 is axially adjusted into the respective sleeve position, and the rollers 9*a* and 9*b* arranged on said roller sleeve are axially adjusted into the respective roller position when axially guiding the switching pin 13 in the guide groove 8. In the third embodiment, the valve control 1 moreover corresponds to the valve control 1 in the second embodiment shown in FIG. 1 to FIG. 5.

No moving bolt 14 is provided in the third embodiment of the valve control 1, so that the mass, which is to be moved, and the necessary installation space are advantageously reduced.

Figure 8:
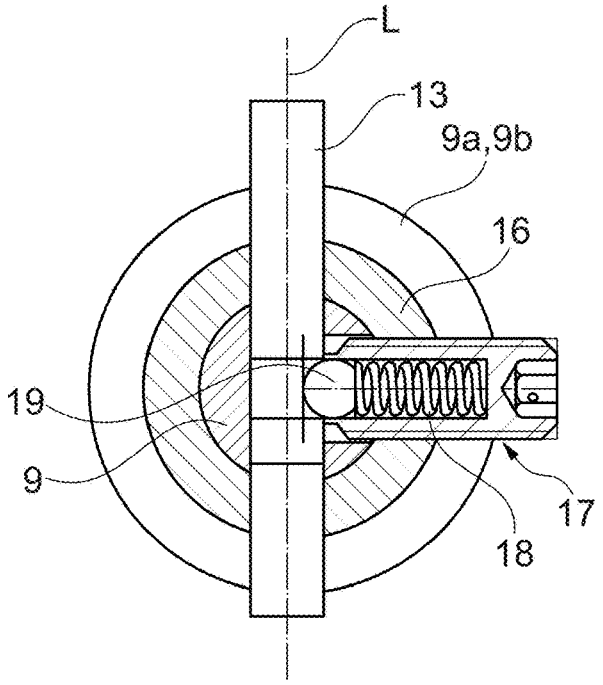
FIG. 8 shows a sectional view through a roller bolt in the valve control in the third embodiment.

FIG. 8 shows a sectional view through the roller bolt 9 in the valve control 1 in the third embodiment. A pin latching unit 17 is shown here, which holds the switching pin 13 in the home position and in the switching position. The pin latching unit 17 thereby has a spring 18 and a latching element 19, which are secured to the roller sleeve 16 and which, transversely to the longitudinal central axis L of the switching pin 13, cooperate with the latter. The switching pin 13 is shown in the switching position in FIG. 8.

Figure 9:
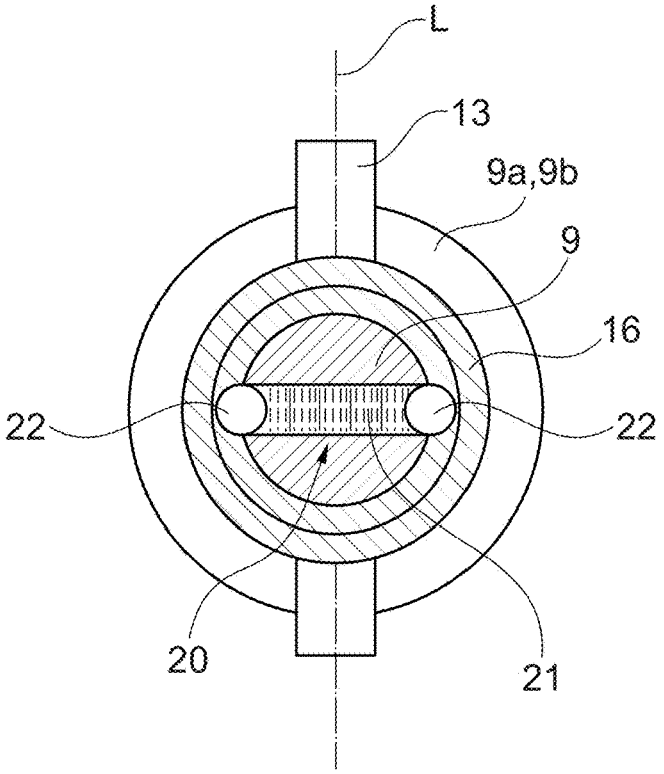
FIG. 9 shows a further sectional view through a roller bolt in the valve control in the third embodiment.

FIG. 9 shows a further sectional view through the roller bolt 9 in the valve control 1 in the third embodiment. The sleeve latching unit 20 is shown here, which holds the roller sleeve 16 in the respective sleeve position. The sleeve latching unit 20 thereby has a spring 21 and two latching elements 22, which are secured inside the roller bolt 9 and which cooperate with the roller sleeve 16 radially to the roller bolt 9.

In summary, the installation space requirement for the valve control 1 according to the invention is reduced, so that the valve control 1 is also realized in the case of small cylinder spacings as well as in the case of SOHC engines. The valve control 1 is thereby embodied in a robust and simple way, and the number of the components as well as the mass, which is to be moved, are reduced in an advantageous manner.

The invention claimed is:

1. A valve control for an internal combustion engine, the valve control comprising:

a tilt lever shaft and a tilt lever rotatably mounted on the tilt lever shaft;

a cam shaft extending parallel to the tilt lever shaft;

two cam groups arranged on the cam shaft axially spaced apart from each other, the two cam groups each including a first cam and an axially adjacent second cam;

a roller bolt fixed to the tilt lever and extending parallel to the cam shaft, the roller bolt including two rotatable rollers disposed axially spaced apart from each other; and an adjusting assembly including a switching pin extending perpendicularly through the roller bolt, the switching pin configured to be radially adjusted into a switching position and into a home position with respect to the roller bolt;

wherein the switching pin engages a slotted guide disposed on the cam shaft when in the switching position and the switching pin is disengaged from the slotted guide when in the home position;

wherein, when the switching pin is in the switching position, the two rollers are configured to be axially adjusted between two roller positions via the adjusting assembly;

wherein, when the two rollers are in a first roller position of the two roller positions, the two rollers are respectively drive-connected to the first cam of each cam group;

wherein, when the two rollers are in a second roller position of the two roller positions, the two rollers are respectively drive-connected to the second cam of each cam group;

wherein the slotted guide is coupled to the cam shaft in a rotationally fixed manner between the two cam groups;

wherein the two rollers are arranged on the roller bolt in an axially movable manner and the switching pin is arranged between the two rollers in an axially coupled manner such that the switching pin and the two rollers are configured to move as a unit with respect to an axial direction of the roller bolt; and wherein when the switching pin is in the switching position, the switching pin is moved along the axial direction of the roller bolt such that the two rollers are adjusted into one of the two roller positions.

2. The valve control according to claim 1, wherein:

the two rollers are spaced apart from each other and secured to a roller sleeve configured to move along the axial direction of the roller bolt such that the switching pin is axially coupled to the two rollers via the roller sleeve;

when the switching pin is in the switching position, the switching pin is configured to axially adjust the roller sleeve into a first sleeve position and into a second sleeve position with respect to the roller bolt; and the first sleeve position and the second sleeve position correspond to the first roller position and the second roller position, respectively.

3. The valve control according to claim 2, further comprising a sleeve latching unit including at least one spring and at least one latch, wherein the sleeve latching unit is secured inside the roller bolt and configured to perpendicularly engage the roller sleeve so as to alternately hold the roller sleeve in the first sleeve position and the second sleeve position.

4. The valve control according to claim 2, further comprising a pin latching unit including at least one spring and at least one latch, wherein the pin latching unit is secured to the roller sleeve and configured to perpendicularly engage the switching pin so as to alternately hold the switching pin in the switching position and the home position.

5. The valve control according to claim 2, further comprising a pressure latching unit including at least one pressure piece, wherein the pressure latching unit is secured to the roller sleeve configured to perpendicularly engage the switching pin so as to alternately hold the switching pin in the switching position and the home position.

6. The valve control according to claim 1, wherein:

the switching pin is further coupled to a moving bolt, the moving bolt mounted to the in an axially movable manner and extending parallel to the roller bolt;

when the switching pin is in the switching position, the switching pin is configured to axially adjust the moving bolt into a first bolt position and into a second bolt position with respect to the tilt lever; and the first bolt position and the second bolt position correspond to the first roller position and the second roller position, respectively.

7. The valve control according to claim 6, wherein:

the two rollers are spaced apart from each other and secured to a roller sleeve configured to move along the axial direction of the roller bolt; and the switching pin is axially coupled to the two rollers via the roller sleeve.

8. The valve control according to claim 6, wherein each of the two rollers is at least partially encompassed by an entraining unit secured to the moving bolt such that the switching pin is axially coupled to the two rollers via the entraining unit and the moving bolt.

9. The valve control according to claim 8, wherein:

at least one roller of the two rollers is at least partially encompassed by the entraining unit via two stop surfaces;

the two stop surfaces are axially spaced apart from each other with respect to the moving bolt; and an axial distance between the two stop surfaces defines an axial functional play of the at least one roller.

10. The valve control according to claim 8, wherein the entraining unit is structured as a single, unitary piece.

11. The valve control according to claim 10, wherein the entraining unit is formed from sheet metal.

12. The valve control according to claim 6, wherein the moving bolt is mounted to the tilt lever via a fork-shaped lever holder of the tilt lever.

13. The valve control according to claim 12, wherein:

a first longitudinal end of the moving bolt is mounted in the fork-shaped lever holder in a rotationally fixed and form-fitting manner via a securing member; and a second longitudinal end of the moving bolt is mounted in the fork-like lever holder via a bolt latching unit configured to alternately hold the moving bolt in the first bolt position and the second bolt position.

14. The valve control according to claim 6, further comprising a pin latching unit including at least one spring and at least one latch, wherein the pin latching unit is secured inside the moving bolt and configured to perpendicularly engage the switching pin so as to alternately hold the switching pin in the switching position and the home position.

15. The valve control according to claim 1, wherein the switching pin engages the slotted guide via an elongated hole disposed in the roller bolt.

16. The valve control according to claim 1, wherein an axial spacing between the two cam groups is defined by the slotted guide.

17. The valve control according to claim 1, wherein the slotted guide includes an X-shaped guide groove.

18. A valve control for an internal combustion engine, comprising:

a tilt lever shaft and a tilt lever rotatably mounted on the tilt lever shaft;

a cam shaft extending parallel to the tilt lever shaft;

two cam groups arranged on the cam shaft axially spaced apart from each other, the two cam groups each including a first cam and an axially adjacent second cam;

a roller bolt fixed to the tilt lever and extending parallel to the cam shaft, the roller bolt including two rotatable rollers disposed axially spaced apart from each other; and an adjusting assembly including a switching pin extending perpendicularly through the roller bolt, the switching pin configured to be radially adjusted into a switching position and into a home position with respect to the roller bolt;

wherein the switching pin engages a slotted guide disposed on the cam shaft when in the switching position and the switching pin is disengaged from the slotted guide when in the home position;

wherein, when the switching pin is in the switching position, the two rollers are configured to be axially adjusted between two roller positions via the adjusting assembly;

wherein, when the two rollers are in a first roller position of the two roller positions, the two rollers are respectively drive-connected to the first cam of each cam group;

wherein, when the two rollers are in a second roller position of the two roller positions, the two rollers are respectively drive-connected to the second cam of each cam group;

wherein the slotted guide is coupled to the cam shaft in a rotationally fixed manner between the two cam groups;

wherein the two rollers are arranged on the roller bolt in an axially movable manner and the switching pin is arranged between the two rollers in an axially coupled manner such that the switching pin and the two rollers are configured to move as a unit with respect to an axial direction of the roller bolt;

wherein when the switching pin is in the switching position, the switching pin is moved along the axial direction of the roller bolt such that the two rollers are adjusted into one of the two roller positions;

wherein an axial spacing between the two cam groups is defined by the slotted guide; and wherein the slotted guide includes an X-shaped guide groove.

19. The valve control according to claim 18, wherein:

the switching pin is further coupled to a moving bolt, the moving bolt mounted to the tilt lever in an axially movable manner and extending parallel to the roller bolt;

when the switching pin is in the switching position, the switching pin is configured to axially adjust the moving bolt into a first bolt position and into a second bolt position with respect to the tilt lever; and the first bolt position and the second bolt position correspond to the first roller position and the second roller position, respectively.

20. A valve control for an internal combustion engine, comprising:

a tilt lever shaft and a tilt lever rotatably mounted on the tilt lever shaft;

a cam shaft extending parallel to the tilt lever shaft;

two cam groups arranged on the cam shaft axially spaced apart from each other, the two cam groups each including a first cam and an axially adjacent second cam;

a roller bolt fixed to the tilt lever and extending parallel to the cam shaft, the roller bolt including two rotatable rollers disposed axially spaced apart from each other; and an adjusting assembly including a switching pin extending perpendicularly through the roller bolt, the switching pin configured to be radially adjusted into a switching position and into a home position with respect to the roller bolt;

wherein the switching pin engages a slotted guide disposed on the cam shaft when in the switching position and the switching pin is disengaged from the slotted guide when in the home position;

wherein, when the switching pin is in the switching position, the two rollers are configured to be axially adjusted between two roller positions via the adjusting assembly;

wherein, when the two rollers are in a first roller position of the two roller positions, the two rollers are respectively drive-connected to the first cam of each cam group;

wherein, when the two rollers are in a second roller position of the two roller positions, the two rollers are respectively drive-connected to the second cam of each cam group;

wherein the slotted guide is coupled to the cam shaft in a rotationally fixed manner between the two cam groups;

wherein the two rollers are arranged on the roller bolt in an axially movable manner and the switching pin is arranged between the two rollers in an axially coupled manner such that the switching pin and the two rollers are configured to move as a unit with respect to an axial direction of the roller bolt;

wherein, when the switching pin is in the switching position, the switching pin is moved along the axial direction of the roller bolt such that the two rollers are adjusted into one of the two roller positions;

wherein the switching pin engages the slotted guide via an elongated hole disposed in the roller bolt; and wherein the slotted guide includes an X-shaped guide groove.

* * * * *